US007077337B2

(12) United States Patent
Onishi et al.

(10) Patent No.: US 7,077,337 B2
(45) Date of Patent: Jul. 18, 2006

(54) HIGH PRESSURE FUEL SUPPLY APPARATUS

(75) Inventors: Yoshihiko Onishi, Tokyo (JP); Takuya Uryu, Tokyo (JP); Yuta Ichinose, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/286,849

(22) Filed: Nov. 4, 2002

(65) Prior Publication Data

US 2003/0222154 A1 Dec. 4, 2003

(30) Foreign Application Priority Data

May 28, 2002 (JP) ..... P 2002-153800

(51) Int. Cl.
*F02M 47/02* (2006.01)

(52) U.S. Cl. ..... 239/88; 239/533.2

(58) Field of Classification Search ..... 239/88, 239/89, 90, 91, 92, 93, 94, 95, 533.2, 533.9, 239/533.11
See application file for complete search history.

(56) References Cited

U.S. PATENT DOCUMENTS 5,253,418 A * 10/1993 Taniguchi et al. ..... 29/888.43
5,289,804 A * 3/1994 Mori ..... 123/90.51
5,349,748 A * 9/1994 Hara ..... 29/888.43
5,752,430 A * 5/1998 Kawajiri et al. ..... 92/129
5,957,381 A * 9/1999 Wakamatsu et al. ..... 239/88
5,979,416 A 11/1999 Berger
6,350,107 B1 2/2002 Hamutcu
6,364,641 B1 * 4/2002 Mori ..... 239/533.3
2002/0189438 A1 12/2002 Furuta

FOREIGN PATENT DOCUMENTS

FR 2 526 494 A 11/1983
JP 08135764 A * 5/1996
JP 3199105 6/2001
JP 2002-510015 A 4/2002

* cited by examiner

*Primary Examiner*—Christopher Kim
(74) *Attorney, Agent, or Firm*—Sughrue Mion, PLLC

(57) ABSTRACT

A high pressure fuel supply apparatus 6 having: a plunger 161 reciprocating and sliding in a sleeve 160 of a high pressure fuel pump 16 so as to form a fuel pressurizing chamber 163 between the plunger 161 and the sleeve 160 to thereby discharge pressurized fuel; a tappet 164 reciprocated while abutting against the plunger 161; and a cam 100 abutting against the tappet 164 so as to reciprocate the tappet 164 and the plunger 161; wherein the tappet 164 has a recess portion 164*a* formed near a central portion of an abutment surface of the tappet 164 against the plunger 161.

1 Claim, 6 Drawing Sheets

HIGH PRESSURE FUEL SUPPLY APPARATUS

BACKGROUND OF THE INVENTION

1. Field of the Invention

The present invention relates to a high pressure fuel supply apparatus chiefly for use in a cylinder fuel injection engine or the like.

2. Description of the Related Art

FIG. 6 is a configuration diagram showing a fuel supply system in an internal combustion engine for a vehicle, including a related-art high pressure fuel supply apparatus. In FIG. 6, fuel 2 in a fuel tank 1 is delivered from the fuel tank 1 by a low pressure pump 3, passed through a filter 4, adjusted in pressure by a low pressure regulator 5, and then supplied to a high pressure fuel supply apparatus 6 which is a high pressure pump. Only a flow rate of the fuel 2 required for fuel injection is boosted by the high pressure fuel supply apparatus 6, and supplied into a delivery pipe 9 of an internal combustion engine not-shown. A surplus of the fuel 2 is relieved between a low pressure damper 12 and a suction valve 13 by an electromagnetic valve 17.

In addition, the required fuel flow rate is determined by a control unit not-shown, which also controls the electromagnetic valve 17. The high pressure fuel supplied thus is injected into a cylinder of the internal combustion engine in the form of high pressure mist from a fuel injection valve 10 connected to the delivery pipe 9. When abnormal pressure (high relief valve opening pressure) is placed in the delivery pipe 9, a filter 7 and a high pressure relief valve 8 are opened to prevent the delivery pipe 9 from being broken.

The high pressure fuel supply apparatus 6 which is a high pressure pump, has a filter 11 for filtering the supplied fuel, a low pressure damper 12 for absorbing the pulsation of the low pressure fuel, and a high pressure fuel pump 16 for pressurizing the fuel supplied through the suction valve 13 and discharging the high pressure fuel through a discharge valve 14.

FIG. 7 is a longitudinal sectional view showing a related-art high pressure fuel supply apparatus. In FIG. 7, the high pressure fuel supply apparatus 6 has a casing 61, a high pressure fuel pump 16, an electromagnetic valve 17, and a low pressure damper 12, integrally, wherein the high pressure fuel pump 16 is a plunger pump provided in the casing 61.

A fuel pressurizing chamber 163 surrounded by a sleeve 160 and a plunger 161 inserted slidably in the sleeve 160 is formed in the high pressure fuel pump 16. The other end of the plunger 161 abuts against a tappet 164 shaped like a closed-end cylinder, and the tappet 164 abuts against a cam 100 as a driving unit to drive the high pressure fuel pump 16. The cam 100 is provided integrally or coaxially with a cam shaft 101 of the engine so as to reciprocate the plunger 161 along the profile of the cam 100 in cooperation with the rotation of a crank shaft of the engine. The volume of the fuel pressurizing chamber 163 is changed by the reciprocating motion of the plunger 161 so that the fuel boosted to high pressure is discharged from the discharge valve 14.

In the high pressure fuel pump 16, a plate 162, the suction valve 13 and the sleeve 160 are held between the casing 61 and an end surface of a spring guide 165, and fastened with a bolt 180. The plate 162 forms a fuel suction port 162*a* for sucking fuel from the low pressure damper 12 to the fuel pressurizing chamber 163, and a fuel discharge port 162*b* for discharging the fuel from the fuel pressurizing chamber 163.

The suction valve 13 shaped into a thin plate is formed in the fuel suction port 162*a*. The discharge valve 14 is provided on the fuel discharge port 162*b* so as to communicate with the delivery pipe 9 through a high pressure fuel discharge passageway 62 provided in the casing 61. In addition, in order to suck fuel, a spring 167 for pushing the plunger 161 down in a direction to expand the fuel pressurizing chamber 163 is disposed in the state where the spring 167 has been compressed between the spring guide 165 and a spring holder 168.

The electromagnetic valve 17 has an electromagnetic valve body 170, a valve seat 173, a valve 174, and a compression spring 175. The electromagnetic valve body 170 is incorporated in the casing 61 of the high pressure fuel supply apparatus 6 so as to have a fuel channel 172 inside the electromagnetic valve body 170. The valve seat 173 is provided in the fuel channel 172 of the electromagnetic valve body 170. The valve 174 is held on/off the valve seat 173 in the electromagnetic valve body 170 so as to close/open the fuel channel 172. The compression spring 175 presses the valve 174 onto the valve seat 173.

At a point of time when a flow rate requested from a control unit not-shown has been discharged in a discharge stroke of the high pressure fuel pump 16, a solenoid coil 171 of the electromagnetic valve 17 is excited to open the valve 174. Thus, the fuel 2 in the fuel pressurizing chamber 163 is released to the low pressure side between the low pressure damper 12 and the suction valve 13 so that the pressure in the fuel pressurizing chamber 163 is reduced to be not higher than the pressure in the delivery pipe 9. Thus, the discharge valve 14 is closed. After that, the valve 174 of the electromagnetic valve 17 is opened till the high pressure fuel pump 16 proceeds to a suction stroke. The timing to open the electromagnetic valve 17 is controlled so that the amount of fuel discharged into the delivery pipe 9 can be adjusted.

However, the related-art high pressure fuel supply apparatus has problems as follows. FIGS. 8A to 8C are enlarged views of the vicinity of the abutment portion between the plunger 161 and the tappet 164 in the high pressure fuel pump of the related-art high pressure fuel supply apparatus. FIG. 8A is a longitudinal sectional view, FIG. 8B is a sectional view taken on line A—A, and FIG. 8C is a bottom view. In addition, FIG. 9 is a graph showing the surface pressure distribution in the abutment surface between the tappet and the cam. In FIG. 9, the ordinate designates the surface pressure (MPa), and the abscissa designates the axial length of the cam shaft. The solid line shows the surface pressure distribution at the time of high fuel pressure (15 MPa), and the broken line shows the surface pressure distribution at the time of low fuel pressure (7 MPa).

As shown in FIGS. 8A to 8C, the tappet 164 has a circular abutment surface against the plunger 161 so that the tappet 164 abuts against the plunger 161 all over the abutment surface. In this case, the surface pressure distribution appearing in the abutment surface between the tappet 164 and the cam 100 shows a mountain-like shape taking a peak value in its central portion as shown in FIG. 9. In the comparatively low fuel pressure (e.g. 7 MPa), the deformation of the tappet 164 is limited to small deformation due to the rigidity of the bottom portion of the tappet 164 depending on the board thickness thereof so that the surface pressure distribution becomes comparatively flat. On the other hand, in the high fuel pressure (e.g. 15 MPa), the deformation of the bottom portion of the tappet 164 is so great that the surface pressure distribution shows an obviously mountain-like shape, thereby causing a problem that the central portion of the tappet 164 maybe abraded. When the central portion of the tappet 164 is abraded, the cam 100 is also abraded. Thus, due to the shortness of the discharge quantity caused by the lowering of the cam lift, the engine may halt.

To solve such a problem, it can be considered that the thickness of the bottom portion of the tappet 164 is increased to reduce such deformation. However, there is a problem that the weight of the apparatus increases.

It can be also considered that the curvature radius of the cam 100 is increased to enlarge the contact area of the abutment portion of the cam 100 against the tappet 164 to thereby prevent the abrasion in the central portion of the tappet 164. However, there is a problem that the increased diameter of the cam 100 increases the scale and weight of the apparatus.

Further, measures taken to reduce the outer diameter of the plunger 161 to reduce the load with which the tappet 164 is pressed can be also considered. Adversely, the cam lift increases conspicuously so that the traveling speed of the plunger increases conspicuously. Thus, there is a problem that the plunger 161 is burnt.

SUMMARY OF THE INVENTION

The invention is developed to solve the foregoing problems. It is an object of the invention to provide a high pressure fuel supply apparatus in which the surface pressure distribution in the abutment surface between a tappet and a cam is adjusted so that the apparatus can be made small in size and light in weight.

According to the invention, there is provided a high pressure fuel supply apparatus having: a plunger reciprocating and sliding in a sleeve of a high pressure fuel pump so as to form a fuel pressurizing chamber between the plunger and the sleeve to thereby discharge pressurized fuel; a tappet reciprocated while abutting against the plunger; and a driving unit abutting against the tappet so as to reciprocate the tappet and the plunger; wherein the tappet has a recess portion formed near a central portion of an abutment surface of the tappet against the plunger.

Preferably, a central axis of the plunger is eccentric to a central axis of the recess portion of the tappet in the abutment surface of the tappet against the plunger.

Preferably, an area of the recess portion of the tappet is not larger than an area of the abutment surface of the tappet against the plunger.

DETAILED DESCRIPTION-OF THE PREFERRED EMBODIMENTS

Embodiment 1

Figure 1:
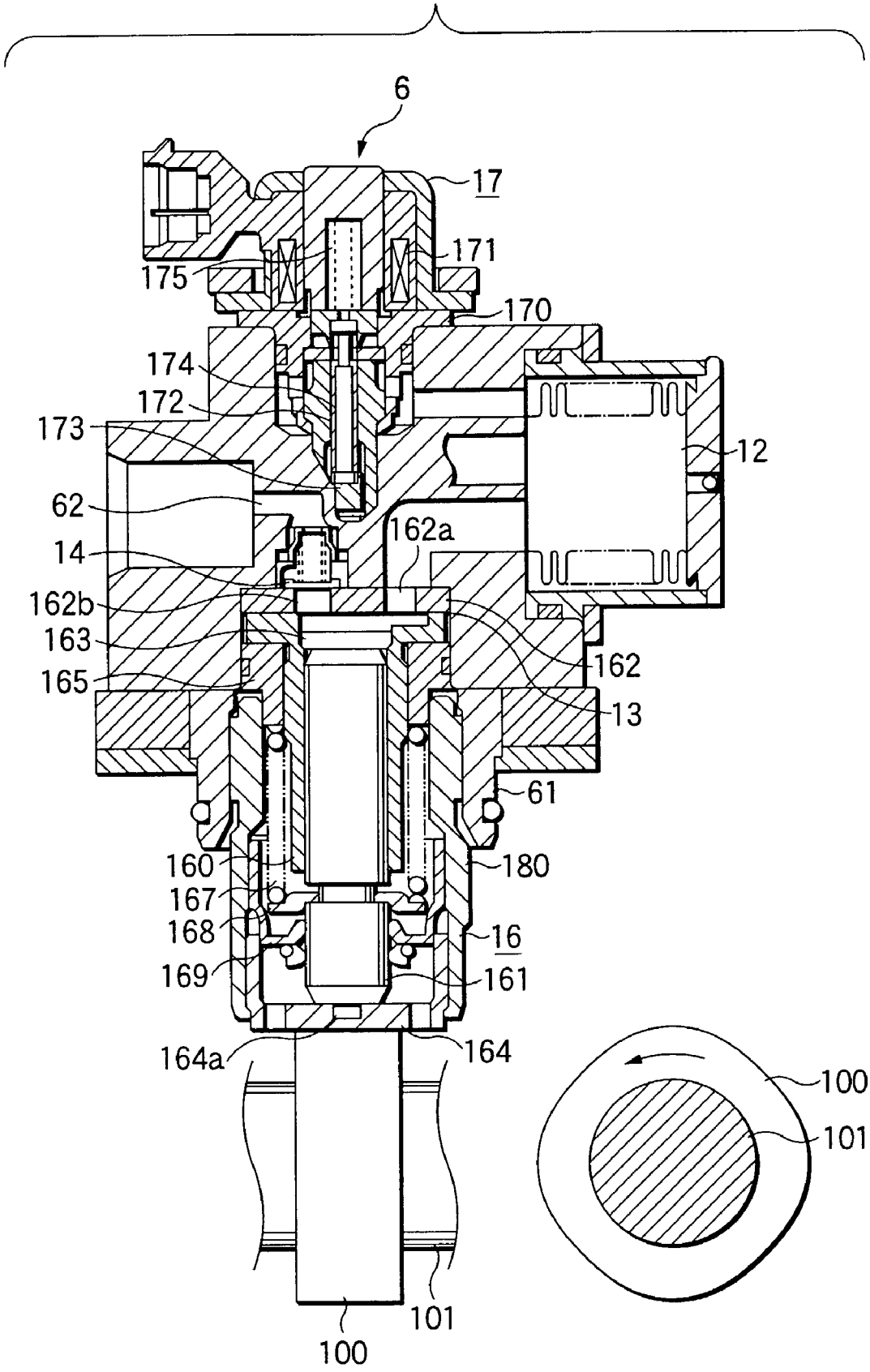
FIG. 1 is a longitudinal sectional view showing a high pressure fuel supply apparatus according to Embodiment 1 of the invention.
Figure 2A:
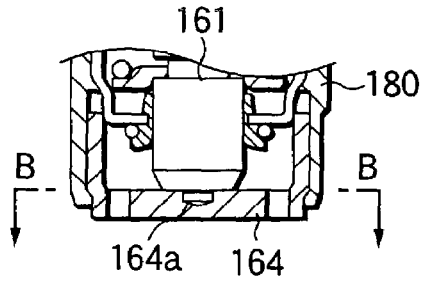
FIGS. 2A to 2C are enlarged sectional views of the vicinity of an abutment portion between a plunger and a tappet in a high pressure fuel pump of the high pressure fuel supply apparatus according to Embodiment 1 of the invention.
Figure 2B:
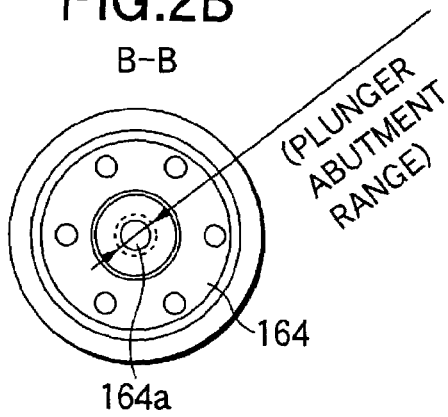
Figure 2C:
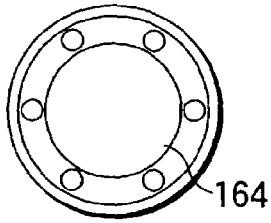

FIG. 1 is a longitudinal sectional view showing a high pressure fuel supply apparatus according to Embodiment 1 of the invention. In addition, FIGS. 2A to 2C are enlarged views of the vicinity of an abutment portion between a plunger and a tappet in a high pressure fuel pump in FIG. 1. FIG. 2A is a longitudinal sectional view, FIG. 2B is a sectional view taken on line B—B, and FIG. 2C is a bottom view. Incidentally, a fuel supply system including this high pressure fuel supply apparatus is fundamentally similar to that in the related-art example, and its detailed description will be omitted. In addition, the configuration of an electromagnetic valve 17 is fundamentally similar to that in the related-art example, and its detailed description will be therefore omitted. Further, the configuration of a high pressure fuel pump 16 is fundamentally similar to that in the related-art example, except the portions which will be described below in detail.

That is, in this embodiment, as shown in FIG. 1 and FIGS. 2A to 2C, a circular recess portion 164*a* is formed in the central portion of the abutment surface of a tappet 164 against a plunger 161. Accordingly, the load generated from the plunger 161 is transmitted to the abutment surface of the tappet 164 against a cam 100 through the outer edge of the recess portion 164*a*. Thus, the load is not applied from the plunger 161 directly to the portion just under the recess portion 164*a*, that is, to the central portion of the abutment surface between the tappet 164 and the cam 100. As a result, the surface pressure generated in the central portion of the abutment surface between the tappet 164 and the cam 100 can be reduced. In addition, in the surface of the tappet 164 abutting against the cam 100 just under the recess portion 164*a*, the surface pressure is generated by the reaction force from the cam 100 rather than the force given by the plunger 161, so that the influence of the rigidity of the board thickness just under the recess portion 164*a* becomes dominative. Thus, by adjusting the board thickness just under the recess portion 164*a*, the peak value of the surface pressure generated in the central portion of the abutment surface between the tappet 164 and the cam 100 can be controlled to be a desired value.

Figure 3:
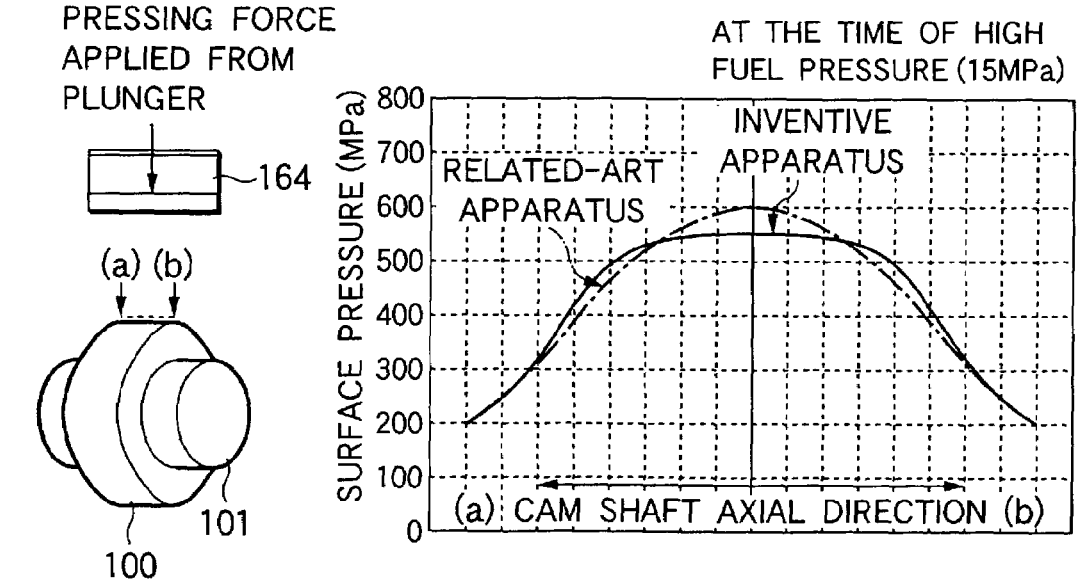
FIG. 3 is a graph showing the surface pressure distribution in the abutment surface between the tappet and a cam in the high pressure fuel pump of the high pressure fuel supply apparatus according to Embodiment 1 of the invention, and that according to the related art.
Figure 8A:
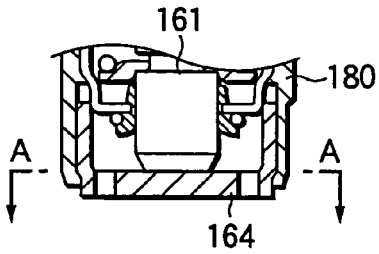
FIG.8A Prior Art
FIGS. 8A to 8C are enlarged sectional views of the vicinity of an abutment portion between a plunger and a tappet in a high pressure fuel pump of the related-art high pressure fuel supply apparatus.
Figure 8B:
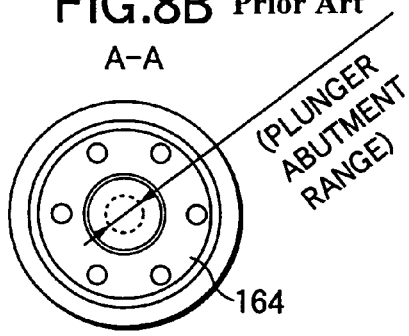
FIG.8B Prior Art
Figure 8C:
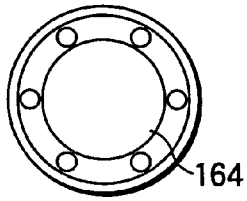
FIG.8C Prior Art

FIG. 3 is a graph showing the surface pressure distribution in the abutment surface between the tappet and the cam in FIGS. 2A to 2C. FIG. 3 shows the surface pressure distribution at the time of high fuel pressure (15 MPa). In FIG. 3, the ordinate designates the surface pressure (MPa), and the abscissa designates the axial length of the cam 100. The solid line shows the surface pressure distribution in the high pressure fuel pump according to this embodiment, and the broken line shows the surface pressure distribution in a related-art high pressure fuel pump (similar to that shown in FIG. 8). As shown in FIG. 3, according to this embodiment, it is understood that the surface pressure generated in the central portion of the abutment surface of the tappet 164 against the cam 100 is lower than that in the related-art example. Accordingly, abrasion is prevented from occurring in the central portion of the tappet 164, so that the durability of the tappet 164 can be improved. Then, as a result, the abrasion on the cam 100 side can be also prevented. Thus, the shortness of the discharge quantity caused by the lowering of the cam lift is solved so that a high flow rate can be provided in the high pressure fuel supply apparatus.

In addition, it is not necessary to take measures to increase the board thickness in the bottom portion of the tappet 164 or increase the curvature radius of the cam 100 as in the related-art examples. Thus, since the surface pressure distribution can be adjusted by only the shape of the tappet 164, the apparatus can be made small in size and light in weight. Further, it is not necessary to take measures to reduce the outer diameter of the plunger 161. Thus, the plunger 161 can be prevented from burning.

Embodiment 2

Figure 4A:
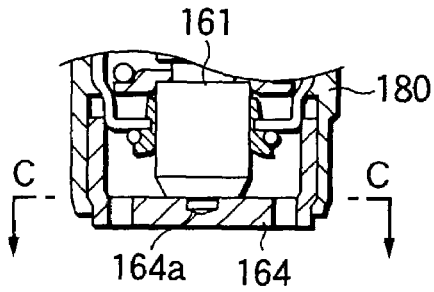
FIGS. 4A to 4C are enlarged sectional views of the vicinity of an abutment portion between a plunger and a tappet in a high pressure fuel pump of a high pressure fuel supply apparatus according to Embodiment 2 of the invention.
Figure 4B:
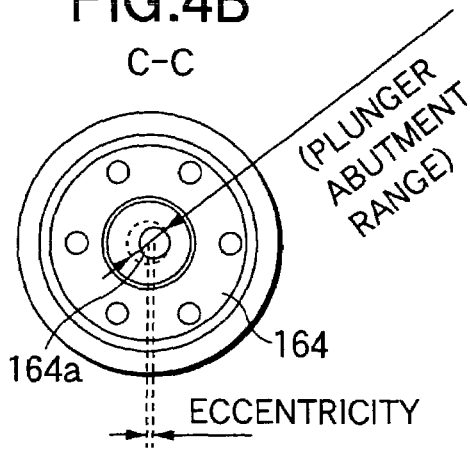
Figure 4C:
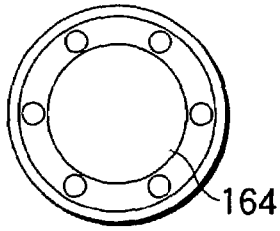
Figure 5:
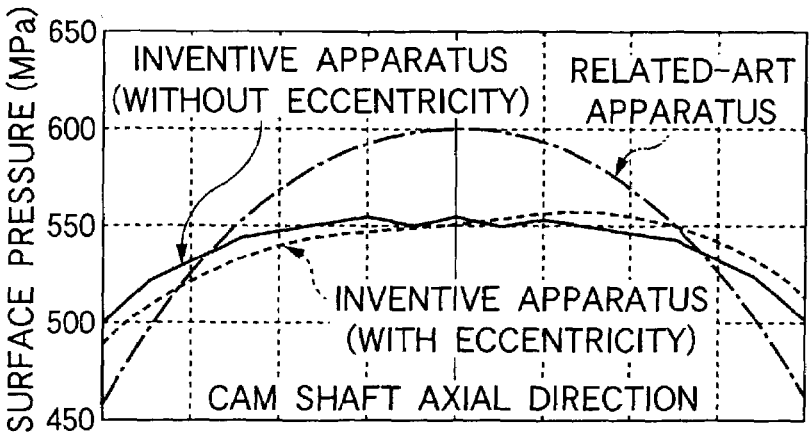
FIG. 5 is a graph showing the surface pressure distribution in the abutment surface between the tappet and a cam in the high pressure fuel pump of the high pressure fuel supply apparatus according to Embodiment 2 of the invention.
Figure 6:
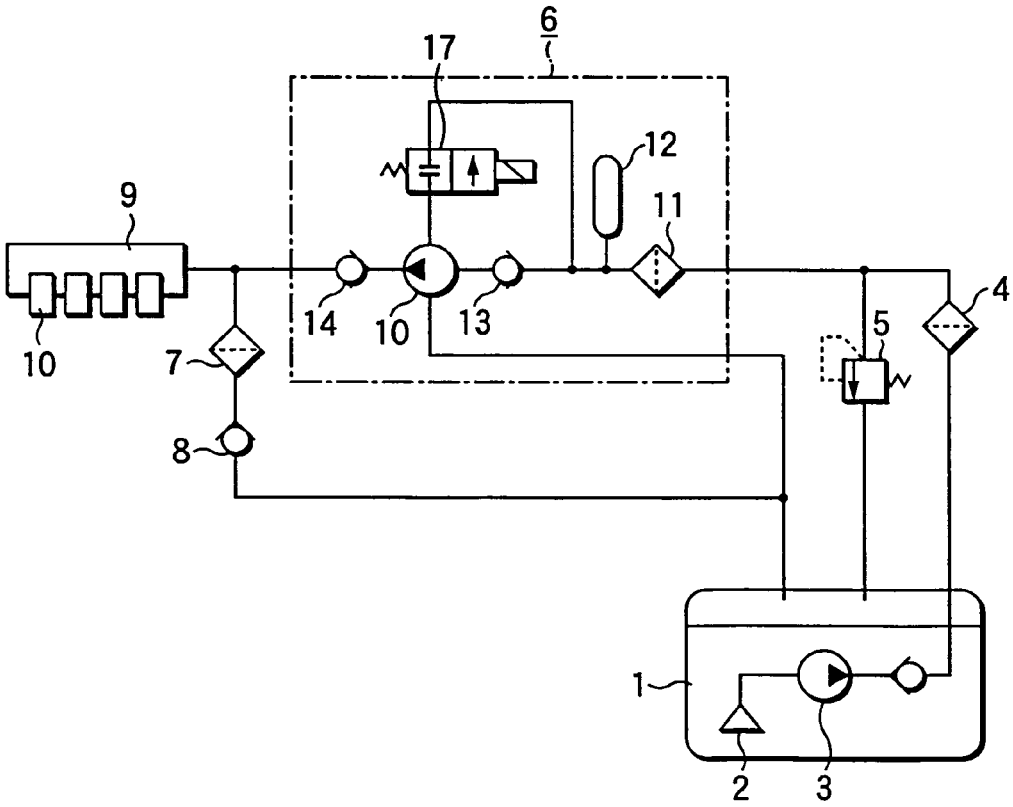
FIG.6 Prior Art
FIG. 6 is a configuration diagram showing a fuel supply system in an internal combustion engine for a vehicle including a related-art high pressure fuel supply apparatus.
Figure 7:
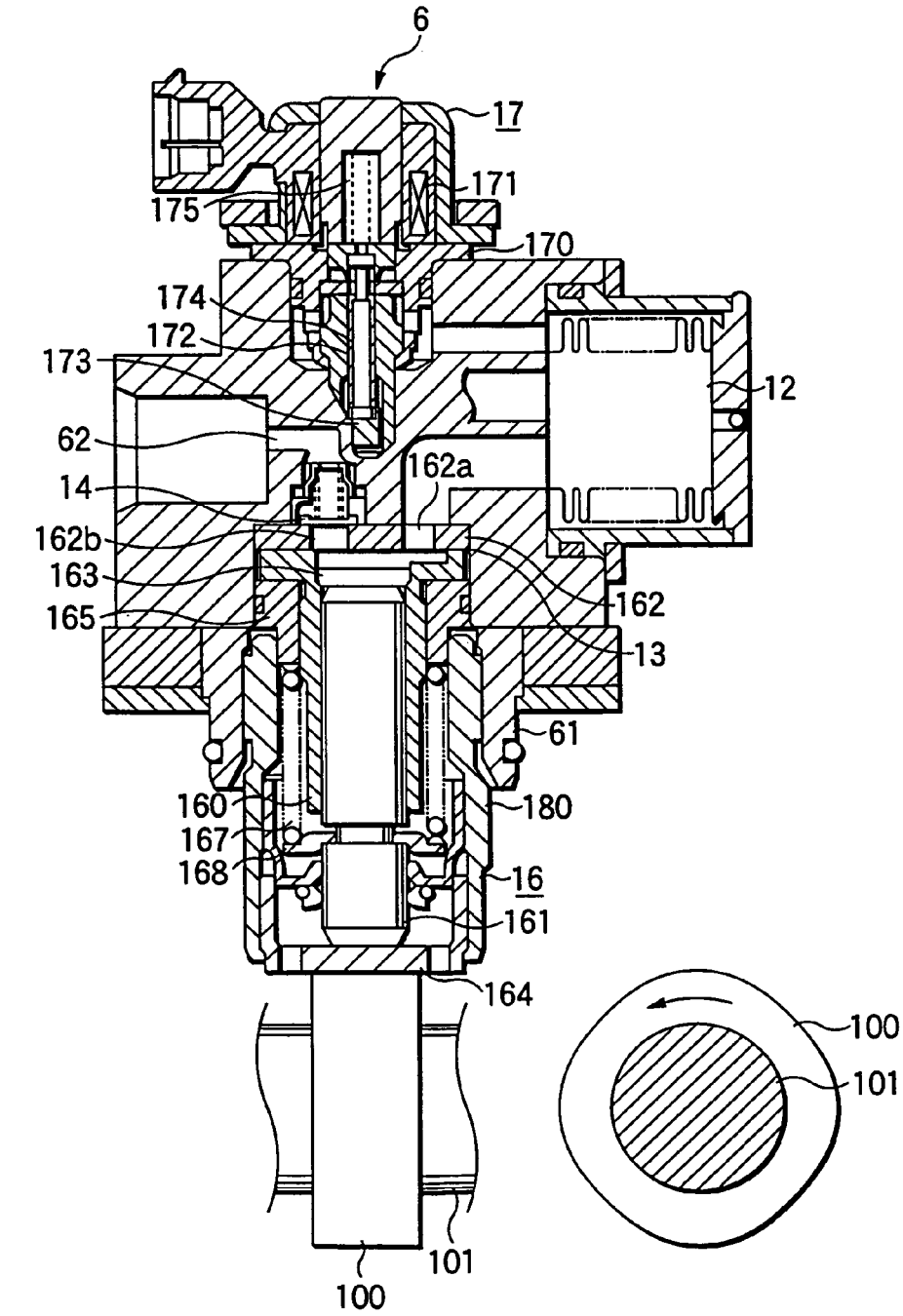
FIG.7 Prior Art
FIG. 7 is a longitudinal sectional view showing the related-art high pressure fuel supply apparatus.
Figure 9:
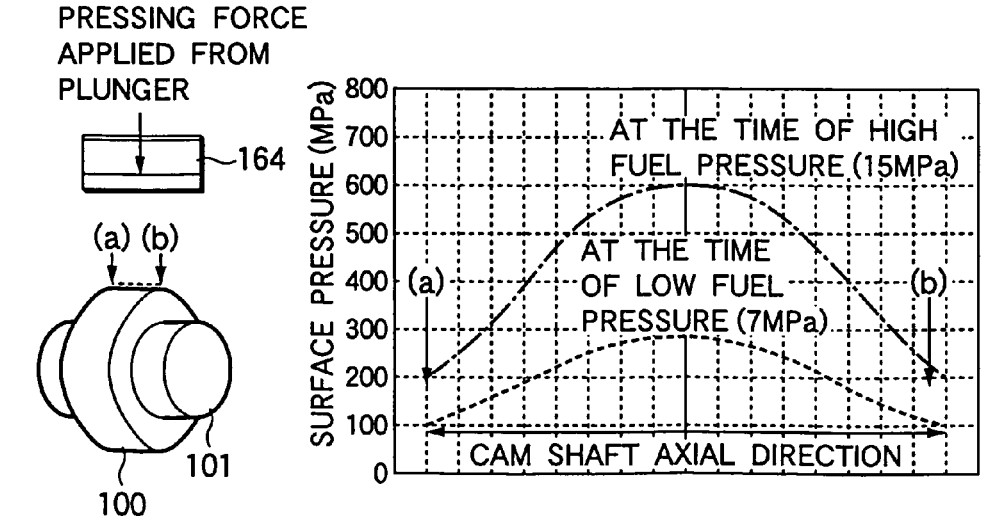
FIG.9 Prior Art
FIG. 9 is a graph showing the surface pressure distribution in the abutment surface between the tappet and a cam in the high pressure fuel pump of the related-art high pressure fuel supply apparatus.

FIGS. 4A to 4C are enlarged views of the vicinity of an abutment portion between a plunger and a tappet in a high pressure fuel pump of a high pressure fuel supply apparatus according to Embodiment 2 of the invention. FIG. 4A is a longitudinal sectional view, FIG. 4B is a sectional view taken on line C—C, and FIG. 4C is a bottom view. In addition, FIG. 5 is a graph showing the surface pressure distribution in the abutment surface between the tappet and a cam in the high pressure fuel pump of the high pressure fuel supply apparatus according to Embodiment 2 of the invention. In FIG. 5, the ordinate designates the surface pressure (MPa), and the abscissa designates the axial length of the cam 100. The broken line shows the surface pressure distribution in the high pressure fuel pump according to this embodiment, the solid line shows the surface pressure distribution in the high pressure fuel pump according to Embodiment 1, and the chain line shows the surface pressure distribution in a related-art high pressure fuel pump (similar to that shown in FIG. 9).

Although Embodiment 1 was described on the configuration in which the central axis of the plunger 161 was identical to the central axis of the recess portion 164*a* of the tappet 164 in the abutment surface of the tappet 164 against the plunger 161, this embodiment has a configuration in which the central axis of the plunger 161 is eccentric to the central axis of the recess portion 164*a* of the tappet 164 as shown in FIG. 4B. For example, the eccentricity is set to be 0.5–1.0 mm in this embodiment.

With such a configuration, as shown in FIG. 5, the surface pressure distribution in the abutment surface between the tappet 164 and the cam 100 becomes asymmetric with respect to the central axis of the tappet 164 in comparison with that according to Embodiment 1. Accordingly, the tappet 164 rotates on its axis due to the torque of the cam 100, so that the load caused by the abutment between the tappet 164 and the cam 100 is not generated at one and the same place but is dispersed. Thus, the durability of the tappet 164 can be improved.

Incidentally, in the respective embodiments described above, the shape of the recess portion 164*a* of the tappet 164, the board thickness of the bottom portion of the tappet 164, and the eccentricity between the central axis of the plunger 161 and the central axis of the recess portion 164*a* of the tappet 164 do not have to be adjusted by trail and error through design/investigation, trial production and endurance test, but are set by analysis using a finite element method. Thus, a substantially valid surface pressure distribution can be grasped in the planning stage so that the apparatus can be developed in a short time.

As described above, according to aspect 1 of the invention, there is provided a high pressure fuel supply apparatus having: a plunger reciprocating and sliding in a sleeve of a high pressure fuel pump so as to form a fuel pressurizing chamber between the plunger and the sleeve to thereby discharge pressurized fuel; a tappet reciprocated while abutting against the plunger; and a driving unit abutting against the tappet so as to reciprocate the tappet and the plunger; wherein the tappet has a recess portion formed near a central portion of an abutment surface of the tappet against the plunger. Accordingly, abrasion is prevented from occurring in the central portion of the tappet so that the durability of the tappet can be improved. Thus, there is an effect to obtain a high pressure fuel supply apparatus small in size and light in weight.

Further, according to aspect 2 of the invention, a central axis of the plunger is eccentric to a central axis of the recess portion of the tappet in the abutment surface of the tappet against the plunger. Accordingly, the load caused by the abutment between the tappet and the cam is not generated at one and the same place, but is dispersed. Thus, there is obtained an effect that the durability of the tappet can be improved.

Further, according to aspect 3 of the invention, an area of the recess portion of the tappet is not larger than an area of the abutment surface of the tappet against the plunger. Accordingly, abrasion is prevented from occurring in the central portion of the tappet, so that the durability of the tappet can be improved. Thus, there is an effect to obtain a high pressure fuel supply apparatus small in size and light in weight.

What is claimed is:

1. A high pressure fuel supply apparatus comprising:

a plunger reciprocating and sliding in a sleeve of a high pressure fuel pump so as to form a fuel pressurizing chamber between said plunger and said sleeve to discharge pressurized fuel;

a tappet reciprocated with abutting against said plunger; and a driving unit abutting against said tappet so as to reciprocate said tappet and said plunger, wherein said tappet has a recess portion formed near a central portion of an abutment surface of said tappet against said plunger, wherein a central axis of said plunger is eccentric to a central axis of said recess portion of said tappet in said abutment surface of said tappet against said plunger.

* * * * *